United States Patent [19]

Durham

[11] Patent Number: 4,907,725

[45] Date of Patent: Mar. 13, 1990

[54] LIQUID DISPENSER MIXING NOZZLE

[75] Inventor: Samuel Durham, San Antonio, Tex.

[73] Assignee: Lancer Corporation, San Antonio, Tex.

[21] Appl. No.: 2,612

[22] Filed: Jan. 12, 1987

[51] Int. Cl.[4] ..... B67D 5/56; B01F 5/06

[52] U.S. Cl. ..... 222/129.1; 222/145; 222/459; 239/432; 239/590.5; 138/42; 366/336; 366/337

[58] Field of Search ..... 222/129.1, 145, 459; 239/432, 590.5, 461, 553.5; 366/336, 337, 338; 138/42

[56] References Cited

U.S. PATENT DOCUMENTS

| | | | |
|---|---|---|---|
| 1,944,810 | 1/1934 | Rogers | 222/129.1 X |
| 2,567,998 | 9/1951 | Griffith | 138/42 |
| 3,119,704 | 1/1964 | Harrell et al. | 366/337 X |
| 3,402,854 | 9/1968 | Marchetti | 222/129.1 |
| 3,652,061 | 3/1972 | Chisholm | 366/337 |
| 4,072,296 | 2/1978 | Doom | 366/337 |
| 4,370,062 | 1/1983 | Moody | 239/432 X |
| 4,478,357 | 10/1984 | Jenkins | 222/129.1 X |
| 4,511,258 | 4/1985 | Federighi et al. | 366/338 X |
| 4,603,813 | 8/1986 | Luegering | 239/432 X |
| 4,614,440 | 9/1986 | King | 366/336 |
| 4,632,568 | 12/1986 | Emele et al. | 366/336 X |

FOREIGN PATENT DOCUMENTS

| | | | |
|---|---|---|---|
| 676901 | 12/1963 | Canada | 366/338 |
| 140653 | 3/1980 | German Democratic Rep. | 366/338 |
| 615270 | 1/1949 | United Kingdom | 222/459 |

*Primary Examiner*—Joseph J. Rolla
*Assistant Examiner*—Gregory L. Huson
*Attorney, Agent, or Firm*—Cox & Smith Incorporated

[57] ABSTRACT

A liquid dispenser mixing nozzle comprising a housing defining a chamber, a dispensing orifice in the housing communicating with the chamber at a first end, a liquid supply source in fluid connection with the chamber at a second end of the chamber, a plurality of baffles substantially perpendicular to the side wall of the housing, and removable circumferential support members for suspending the baffles within the chamber. A method for mixing and dispensing liquid is also provided.

3 Claims, 2 Drawing Sheets

LIQUID DISPENSER MIXING NOZZLE

BACKGROUND OF THE INVENTION

This invention pertains to an apparatus and method for mixing liquid flowing through a conduit. More specifically, the invention pertains to a liquid dispenser mixing nozzle and method for mixing a juice or other beverage concentrate together with water or other diluent, prior to dispensation.

Generally the dispersion of a concentrate in a diluent requires mechanical agitation to assure that the mixture of the concentrate and the diluent is homogeneous. A beverage or juice concentrate is normally viscous, and admixture of a viscous concentrate with a fluid such as water, which has a much lesser dynamic viscosity, is best achieved by creating a turbulent flow in the liquids to be combined.

Beverage dispensers customarily available generally provide liquid release spouts or tubes adjacent to one another. Some beverage dispensers provide mixing chambers for combining a concentrate together with water. A disadvantage of such beverage dispensers is that frequently the juice or beverage concentrate is poorly mixed with the diluent liquid, and the resulting beverage may have an inconsistent quality.

Another problem results from the public demand for juice having greater pulp content which makes it even more difficult to properly mix the juice concentrate with the diluent.

It is an object of the present invention to provide an apparatus and method for mixing liquid flowing through a conduit.

It is another object of the present invention to provide a means for thorough mixing of a beverage concentrate and a liquid diluent, for use in a commercial beverage dispensing apparatus.

Another object of the present invention is to create a turbulent flow of liquid within a conduit by varying the velocity of flow of a liquid within a mixing chamber, thus creating macroscopic fluctuations in liquid flow through a fluid path in the chamber.

A further object of the present invention is to create open channel flow of liquid through a mixing conduit.

Yet another object of the present invention is to create greater shearing stress of liquid flowing within a fluid mixing conduit by providing a tortuous fluid path having a flow pattern characterized by creating repetitious generating flow of a fluid as it passes through a mixing conduit.

Another object of the present invention is to provide an apparatus for homogeneous mixing of a concentrate and a diluent, which apparatus has means for connection for use with standardly available beverage dispensers.

A further object of the present invention is to provide an apparatus for mixing juice concentrate containing pulp together with a diluent, such that the pulp in the juice concentrate does not become clogged in the mixing apparatus.

Additional objects of the present invention will be clear from the following detailed description of the preferred embodiment of the invention.

SUMMARY OF THE INVENTION

Those objects are accomplished by providing a liquid dispenser mixing nozzle comprising a housing defining a chamber, an opening at a first end for receiving fluid within the chamber, a plurality of interdigitated baffles supported within the chamber and substantially perpendicular to the side walls of the chamber, removable means for suspending the baffles within the chamber, and opening at a second end for releasing fluid from the chamber, and means for connecting the mixing chamber to a liquid supply source.

DETAILED DESCRIPTION OF THE PREFERRED EMBODIMENT

Figure 1:
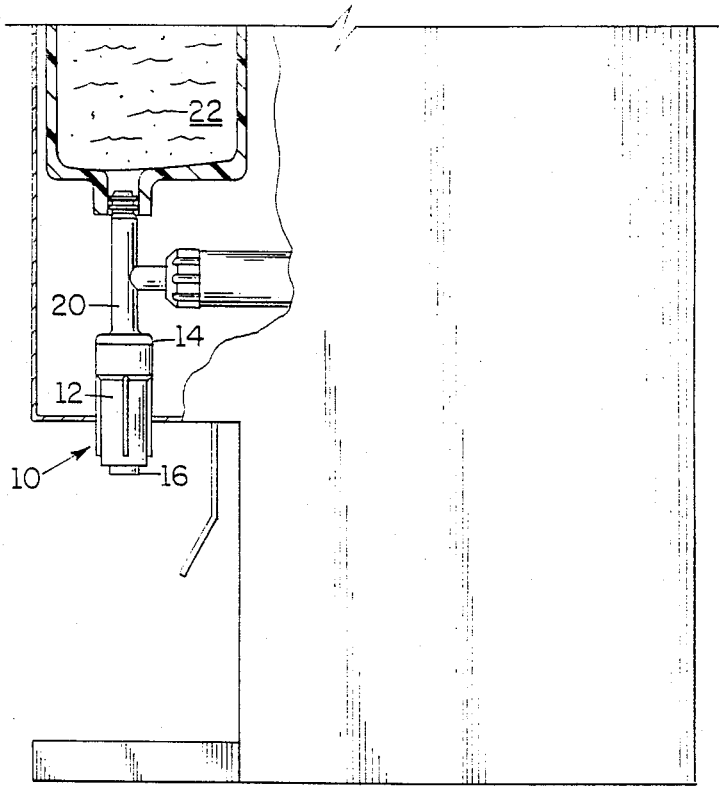
FIG. 1 is a perspective view of a liquid mixing apparatus constructed according to the teachings of the present invention.
Figure 2:
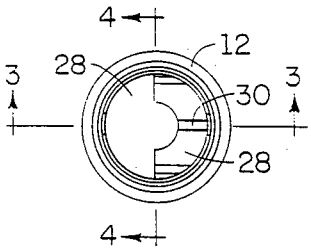
FIG. 2 is a top plan view of the apparatus of FIG. 1.
Figure 3:
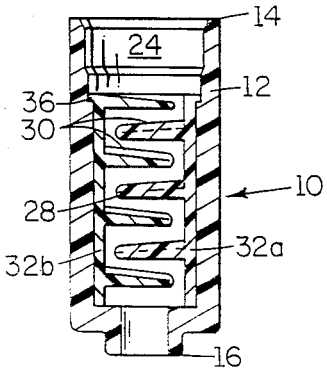
FIG. 3 is a sectional view taken along the lines 3—3 in FIG. 2 of the apparatus of FIG. 1.

The apparatus for mixing a liquid flowing through a conduit of the present invention is indicated generally at reference numeral 10. Mixing device 10 is provided with a housing 12 which in a presently preferred embodiment is generally cylindrical in shape, and defines a generally cylindrical chamber 18 having an inlet 14 and an outlet 16.

The portion of housing 12 which defines inlet 14 in a presently preferred embodiment has a cylindrical bearing surface 24 adapted to slidingly receive the bearing surface 26 of a connector in fluid communication with a liquid supply source 22. Portion of housing 12 defining outlet 16 comprises a dispenser spout in fluid communication with chamber 18. The dispenser spout is of sufficient diameter to allow liquid which has been mixed in chamber 18 to flow out of chamber 18, as for instance when the liquid is being dispensed into a cup or other liquid receptacle (not shown).

Referring to FIGS. 2, 3, 4 and 5, baffles 28 having integral spaced ridges 30 are received within housing 12. The baffles 28 are supported generally perpendicularly to the sides walls of cylindrical bore member 32. In a presently preferred embodiment cylindrical bore member 32 is fomed of two halves **32*a* and 32*b*. The two halves 32*a* and 32*b*, when placed in close juxtaposition with one another form a cylinder which is slidingly received within chamber 18 of housing 12**.

Tabs 34, formed integrally upon halves **32*a* and 32*b* of cylindrical bore member 32, in combination with shoulder 36 of chamber 18, limit the sliding movement of cylindrical bore member 32 within chamber 18. When cylindrical bore member 32 is fully inserted into chamber 18, tabs 34 abut against shoulder 36 of chamber 18. Thus cylindrical bore member 32 does not become jammed within chamber 18, and cylindrical bore member 32 can be removed from chamber 18 for cleaning of the bore member 32 and chamber 18**.

A mixing apparatus constructed according to the teachings of the present invention can be used generally for mixing liquids flowing through a conduit. A presently preferred embodiment constructed according to the teachings of the present invention, is used for mixing of fruit juice beverages. Generally a juice syrup concentrate is mixed together with a diluent such as water in a conduit or mixing chamber prior to being dispensed as a juice beverage.

Many of the juice mixtures currently preferred by consumers in the beverage market contain large amounts of fruit juice pulp, such as would be found in freshly squeezed citrus juices. Such pulp, because of its cellulose and pectin content, can form a glue-like substance if it is mixed in an apparatus having movable parts. In concentrate form such pulp is usually conglomerated in a sticky, adherent mass.

What is desired in a mixing chamber for pulpy fruit juice concentrate is an apparatus which will separate the pulp components into separate pulp fragments while mixing the sugary syrup together with a diluent such as water.

In the mixing apparatus of the present invention ridges 30 spaced apart on baffles 28 separate a liquid stream flowing over the tops of individual baffles 28. In a presently preferred embodiment shown in longitudinal section in FIG. 3, halves 32*a* and 32*b* are constructed so that when halves 32*a* and 32*b* are fitted together forming cylindrical bore member 32, the baffles 28 are interdigitated. Each baffle 28 extends across a portion of the diameter of cylindrical bore member 32. In a presently preferred embodiment of the invention baffles 28 extend across about two-thirds of the diameter of cylindrical bore member 2, so that liquid flowing through chamber 18 encounters alternate baffles in a downwardly flowing pathway.

Figure 4:
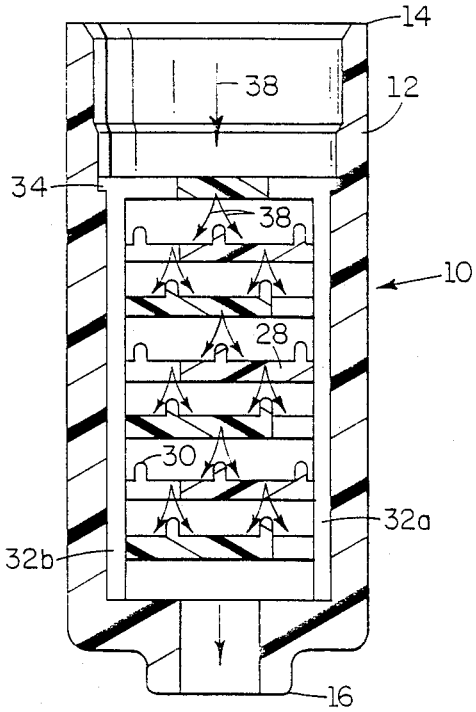
FIG. 4 is a sectional view taken along the lines 4—4 in FIG. 2 of the apparatus of FIG. 1.

Referring to FIG. 4, the flow of liquid through the apparatus of the present invention is designated generally at arrows 38. Liquid enters chamber 18 through inlet 14, and encounters baffles 28 in alternation. Ridges 30 separate the liquid stream in its downwards flow. The liquid then flows out of chamber 18 at dispenser spout 16.

Figure 5:
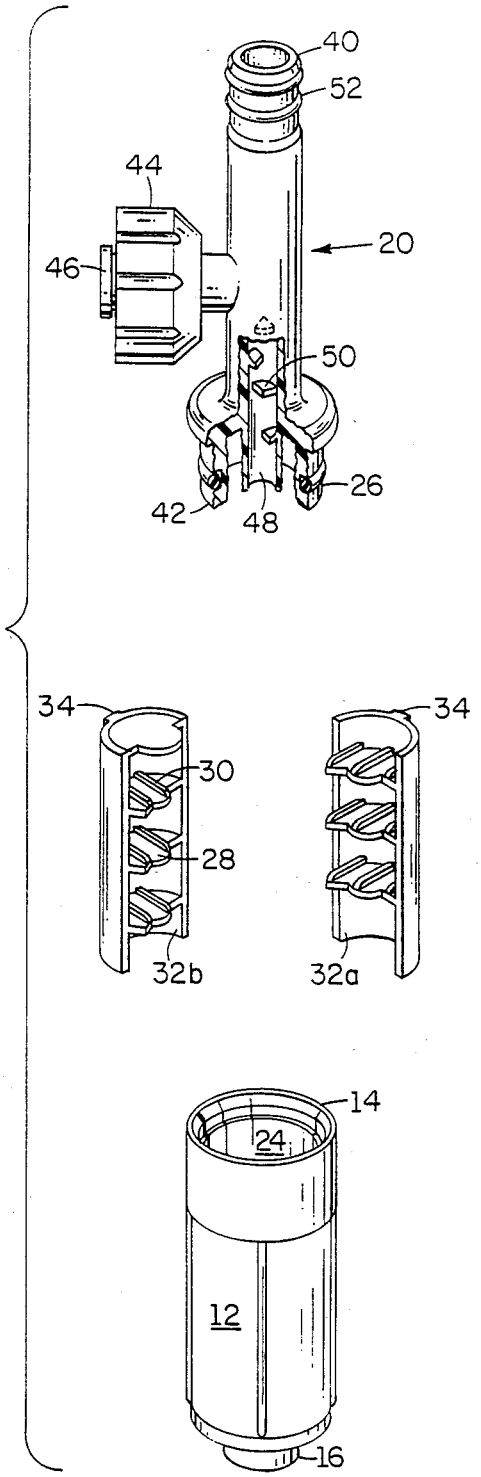
FIG. 5 is an exploded perspective view of a liquid mixing apparatus constructed according to the teachings of the present invention.

FIG. 5 is an exploded perspective view of the apparatus of the present invention. Connector 20 is provided with a first end 40 for fluid connection with a juice concentrate tank, and a second end 42 for fluid connection with housing 12. A cap connector 44 is slidably received on T-member 46, for fluid connection with a second liquid source such as a water line.

Connector 20 has a cylindrical bore 48 with flanges 50 centrally disposed therein substantially perpendicular to and integral with the side wall of bore 48. Those flanges function for mixing liquid within connector 20.

In a presently preferred embodiment bearing surfaces 26 and 52 are provided with "O" rings for sealing connection with fluid sources and with housing 12. An arrow and a dot can also be provided for matching housing 12 circumferentially with housing 20.

The present invention shown in FIG. 1 as used for mixing fruit juice beverages provides fluid connection and mixing of a beverage concentrate and a diluent source prior to dispensing the mixture as a beverage. Bearing surface 26 of connector 20 is inserted into inlet 14 of chabmer 18, and slidably received therein. End 40 of connector 20 is connected to a liquid supply source. Liquids are then permitted to flow into bore 48 of connector 20, and thence through chamber 18 of housing 12. The liquid is then passed out of chamber 18 through outlet 16.

Although the invention has been described in conjunction with the foregoing specific embodiment, many alternatives, variations, and modifications are apparent to those of ordinary skill in the art. Those alternatives, variations and modifications are intended to fall within the spirit and scope of the following claims.

I claim:

1. A beverage mixing nozzle comprising:

a housing defining a mixing chamber having an inlet and an outlet;

a plurality of interdigitated baffles removably received within said mixing chamber, said baffles being substantially horizontal and having a plurality of upwardly protruding ridges;

a cylindrical support member removably received within said mixing chamber, said cylindrical support member formed of at least two adjacent longitudinal members;

said baffles being supported by a sidewall of said cylindrical support member.

2. The apparatus of claim 1 wherein such baffles are substantially perpendicular to the sidewall of said cylindrical support member and are spaced in succession at equidistant intervals, and each of said baffles is tapered toward the distal end thereof.

3. The apparatus of claim 1 wherein said baffles are integrally formed perpendicular to the cylindrical support member.

* * * * *